United States Patent [19]

Sugimoto et al.

[11] Patent Number: 4,775,383

[45] Date of Patent: Oct. 4, 1988

[54] METHOD OF TREATING FIBER

[75] Inventors: Hiroaki Sugimoto, Takatsuki; Kazuo Hayatsu, Ibaraki, both of Japan

[73] Assignee: Sumitomo Chemical Company, Limited, Osaka, Japan

[21] Appl. No.: 871,998

[22] Filed: Jun. 9, 1986

[30] Foreign Application Priority Data

Jun. 17, 1985 [JP] Japan ..... 60-131200
Jun. 18, 1985 [JP] Japan ..... 60-132637

[51] Int. Cl.[4] ..... D06M 11/02; D06M 11/12

[52] U.S. Cl. ..... 8/115.54; 8/115.68; 8/115.69

[58] Field of Search ..... 8/115.6, 115.61, 115.68, 8/115.69; 528/308.2, 272

[56] References Cited

FOREIGN PATENT DOCUMENTS 0126370 7/1985 Japan ..... 8/115.68

*Primary Examiner*—Paul Lieberman
*Assistant Examiner*—John F. McNally
*Attorney, Agent, or Firm*—Stevens, Davis, Miller & Mosher

[57] ABSTRACT

A polyester fiber suitable for reinforcing resin can be obtained by subjecting a fiber obtained by melt-spinning a polyester which exhibits anisotropy in its molten state to (a) a treatment comprising adhering to the fiber a solution of an epoxy group-containing compound dissolved in an organic solvent which is inert to the said compound, and then drying the resulting fiber; or (b) a treatment comprising making the fiber contact with at least one member selected from the group consisting of sulfur trioxide, chlorosulfonic acid, fluorosulfonic acid, and an aqueous sulfuric acid solution having a concentration of 30 to 95% by weight.

5 Claims, No Drawings

METHOD OF TREATING FIBER

FIELD OF THE INVENTION

This invention relates to a method of treating fiber for producing a polyester fiber suitable as a reinforcing fiber for a fiber-reinforced composite material.

BACKGROUND OF THE INVENTION

The technologies related to fiber-reinforced composite materials have made marked progress. As for the resin matrices alone, not only thermosetting resins such as epoxy resin, unsaturated polyester resin, and phenol resin but also thermoplastic resins such as polypropylene, polyamide, and polyethylene terephthalate are widely used. As to the reinforcing fibers, on the other hand, various fibers are studied and produced including glass fiber, and also carbon fiber, aramid fiber, alumina fiber, silicon carbide fiber, and whisker.

It has been attracting attention in recent years that an aromatic polyester which exhibits anisotropy in its molten state can provide a light weight fiber of high strength and high modulus of elasticity in a rational process of melt spinning, which uses no solvent and gives low loss of materials.

In the present state of art, however, when the said aromatic polyester fiber is used in a composite material with a resin, even though the properties of the fiber itself are excellent, the resulting composite material cannot make the most of the excellent properties because of poor adhesion between the fiber and the resin and poor dispersion of the fiber in the resin.

SUMMARY OF THE INVENTION

The object of this invention is to provide a method of treatment for obtaining a fiber suitable for reinforcement which fiber can make the most of the excellent properties of itself to improve the performance of the composite material formed therefrom.

The object of this invention can be achieved by subjecting a fiber obtained by melt-spinning a polyester which exhibits anisotropy in its molten state to (a) a treatment comprising adhering to the fiber a solution of an epoxy group-containing compound dissolved in an organic solvent which is inert to the said compound, and then drying the resulting fiber; or (b) a treatment comprising making the fiber contact with at least one member selected from the group consisting of sulfur trioxide, chlorosulfonic acid, fluorosulfonic acid, and an aqueous sulfuric acid solution having a concentration of 30 to 95% by weight.

DETAILED DESCRIPTION OF THE INVENTION

The polyestcr which exhibits anisotropy in its molten state referred to in this invention means one which has a property of allowing the transmission of light at a temperature region in which it is flowable when the powder sample of the polyester is placed on a heating sample stage positioned between two polarizing plates crossed at an angle of 90° and the temperature of the sample is increased. Such polyesters are those formed of aromatic dicarboxylic acids, aromatic diols and/or aromatic hydroxycarboxylic acids, and the derivatives thereof, disclosed in Japanese Patent Application Kokoku (Post-Exam. Publn.) Nos. 18016/81 and 20008/80, and optionally include copolymers of these with alicyclic dicarboxylic acids, alicyclic diols, aliphatic diols, and the derivatives thereof.

Examples of the aromatic dicarboxylic acids include terephthalic acid, isophthalic acid, 4,4'-dicarboxydiphenyl, 2,6-dicarboxynaphthalene, 1,2-bis(4-carboxyphenoxy)ethane, and the nuclear-substituted products thereof with an alkyl, aryl, alkoxy, or halogen group.

Examples of the aromatic diols include hydroquinone, resorcin, 4,4'-dihydroxydiphenyl, 4,4'-dihydroxybenzophenone, 4,4'-dihydroxydiphenylmethane, 4,4'-dihydroxydiphenylethane, 2,2-bis(4-hydroxyphenyl)-propane, 4,4'-dihydroxydiphenyl ether, 4,4'-dihydroxydiphenyl sulfone, 4,4'-dihydroxydiphenyl sulfide, 2,6-dihydroxynaphthalene, 1,5-dihydroxynaphthalene, and the nuclear-substituted products thereof with an alkyl, aryl, alkoxy, and halogen group.

Examples of the aromatic hydroxycarboxylic acids include p-hydroxybenzoic acid, m-hydroxybenzoic acid, 2-hydroxynaphthalene-6-carboxylic acid, 1-hydroxynaphthalene-5-carboxylic acid, and the nuclear-substituted products thereof with an alkyl, aryl, alkoxy, and halogen group.

Examples of alicyclic dicarboxylic acids include trans-1,4-dicarboxycyclohexane, cis-1,4-dicarboxycyclohexane, and the substituted products thereof with an alkyl, aryl, and halogen group.

Examples of the alicyclic and aliphatic diols include trans-1,4-dihydroxycyclohexane, cis-1,4-dihydroxycyclohexane, ethylene glycol, 1,4-butanediol, and xylylene diol.

Among the combinations of the aforesaid materials, there may be mentioned as examples of a preferable aromatic polyester to be used in this invention:

(1) a copolyester comprising 40 to 70% by mole of p-hydroxybenzoic acid residue, 15 to 30% by mole of an above-mentioned aromatic dicarboxylic acid residue, and 15 to 30% by mole of an aromatic diol residue;

(2) a copolyester formed of terephthalic acid and/or isophthalic acid and chlorohydroquinone, phenylhydroquinone and/or hydroquinone; and (3) a copolyester comprising 20 to 80% by mole o p-hydroxybenzoic acid residue and 20 to 80% by mole of 2-hydroxynaphthalene-6-carboxylic acid residue.

To attain the polyesters to be used in this invention by using these starting materials, they are subjected to polycondensation as they are or after esterified by an aliphatic or aromatic monocarboxylic acid or the derivative thereof, or an aliphatic alcohol, a phenol, or the derivative thereof.

The polycondensation can be carried out by using a known method including mass polymerization, solution polymerization, and suspension polymerization. It may be conducted at 150° to 360° C. under normal pressure or a reduced pressure of 10 to 0.1 Torr optionally in the presence of polymerization catalyst such as a Sb, Ti and Ge compound, a stabilizer such as a phosphorus compound, and fillers such as $TiO_2$, $CaCO_3$, and talc, added thereto. The polymer thus obtained is heat-treated, as it is or in a pulverized form, in an inert gas or under reduced pressure to give a sample material for spinning. It can also be used after once granulated through an extruder.

The melt spinning apparatus to be used for the aromatic polyester according to this invention may be of any desired type.

Suitable temperature for spinning in this invention is 280° to 420° C., more preferably 300° to 400° C. Temperatures lower than the above-mentioned temperature region will result in too large load on the apparatus or insufficiency of uniform melting of the sample, whereas temperatures higher than the region will cause unstable spinning due to decomposition and foaming.

The fibers obtained by melt spinning as mentioned above are then taken up or drawn down as they are or after adhering a textile oil thereto.

Although the fiber thus obtained can be used a they are, they may be subjected, as desired, to drawing, heat treatment, or combination of these.

The fiber thus obtained is subjected to (a) a treatment comprising adhering to the fiber a solution of an epoxy group-containing compound dissolved in an organic solvent which is inert to the said compound, and then drying the resulting fiber; or (b) a treatment comprising making the fiber contact with at least one member selected from the group consisting of sulfur trioxide, chlorosulfonic acid, fluorosulfonic acid, and an aqueous sulfuric acid solution having a concentration of 30 to 95% by weight.

First, the details of the treatment (a) will be described below.

As examples of the epoxy group-containing compounds, mention may be made of epichlorohydrin, glycidyl acrylate, glycidyl methacrylate, phenyl glycidyl ether, glycide, glycidic acid, styrene oxide, glycidylstyrene, 2,2-bis(4-glycidyloxyphenyl)propane, 4,4'-diglycidyloxydiphenyl, p-diglycidyloxybenzene, diglycidyl terephthalate, diglycidyl isophthalate and the like.

As examples of the inert solvent used for dissolving these epoxy group-containing compounds, there may be mentioned acetone, methyl ethyl ketone, ether, dioxane, tetrahydrofuran, methyl cellosolve, benzene, toluene, xylene, hexane, heptane, ethylbenzene, anisol, phenetol, ethyl acetate, and acetonitrile, used each alone or in combinations thereof.

The concentration of the epoxy group-containing compound when dissolved in the organic solvent is preferably 0.05 to 10% by weight, 0.1 to 3% by weight being more preferable from the viewpoint of the solution viscosity suitable for adhesion and economic advantage.

For adhering the solution to the fiber, there may be used such methods as passing the fiber continuously through a vessel containing the solution; blowing the solution against running fiber; or immersing the fiber wound round a bobbin or the like in a vessel containing the solution.

The fiber having the solution adhered thereto is dried under normal or reduced pressure at elevated or ambient temperature to remove the organic solvent. Sometimes it is preferable to heat the fiber further to promote the adhesion or reaction between the fiber polymer on the fiber surface and the epoxy group-containing compound. ( However, the temperature of said heating is preferably 300° C. or lower because temperatures exceeding 300° C. can cause side reaction or decomposition of the epoxy group-containing compound, which can lead to the loss of the effect of the treatment.

In the next place, the details of treatment (b) will be described below.

The contact of sulfur trioxide, chlorosulfonic acid or fluorosulfonic acid with fiber is preferably conducted by a method which uses them in the form of liquid, or one which comprises blowing a gas such as air or nitrogen into a solution of sulfur trioxide, chlorosulfonic acid etc. dissolved in an inert solvent such as fuming sulfuric acid or carbon tetrachloride, to form gas or mist, and then making them contact with the fiber. The gas which is blown into contains preferably no moisture.

Contact of aqueous sulfuric acid solution with fiber may be conducted by immersing the fiber directly in the solution. The aqueous sulfuric acid solution should have a concentration of 30 to 95% by weight, preferably 50 to 95% by weight. At concentrations lower than 30% by weight a satisfactory effect cannot be exhibited, whereas at concentrations higher than 95% by weight the decomposition of the polyester is likely to occur, resulting in deteriorated fiber properties. Although contact at elevation temperatures is sometimes effective for promoting the intended effect, the object of this invention can usually be achieved without causing the decomposition of polyester by conducting the contact at 50° C. or lower.

The contact time should be at least 1 minute, preferably about 5 to 30 minutes.

The treated fiber is used after being washed with water or alcohol.

Use of the fiber subjected to the treatment (a) or (b) enables the excellent properties inherent to the fiber to be reflected directly in the properties of the composite material. Thus, hydrophilic functional groups are introduced onto the fiber surface and resultantly the adhesion between the resin and the fiber is markedly improved by the above-mentioned treatment (a) or (b).

The fiber obtained according to the method of this invention can be combined with thermosetting resins or thermoplastic resins by various processing methods, which include, for example, filament winding, lay up, premixing, and granulation mixing. Examples of resin matrices which can be used include epoxy resin, unsaturated polyester resin, phenol resin, silicone resin, rubber, diallyl phthalate resin, polyolefin, polyester, polyamide, polyamide-imide, polyimide, polyether, polysulfone, polyketone, and polysulfide.

Composite materials obtained from such fibers and resins can be used in such fields as aeroplanes, ships, vehicles, construction, houses, sporting goods, information apparatuses and household electric appliances.

The fiber obtained according to the method of this invention can be used, beside as the reinforcing fiber of composite materials, also as filaments, yarns, ropes and fabrics.

(EXAMPLE)

This invention will be explained further in detail below with reference to Examples and Comparative Examples. However, they are merely for the sake of illustration, and the invention is not limited thereto.

In the examples, the tensile test of the fiber was conducted by using a universal testing machine No. 1130 (mfd. by Instron Co.) with a specimen gap of 20 mm and a stretching rate of 0.5 mm/min.

Optical anisotropy was examined by placing a sample on a heating stage and observing the sample with the naked eye under polarized light while increasing the temperature of the sample at a rate of 25° C./min.

The determination of interlaminar shear strength (hereinafter abbreviated as ILSS) for evaluating the composite material was carried out by three points bending method using a unidirectionally fiber-reinforced molded article having a length of about 20 mm, a thickness of about 2 mm and a width of about 6 mm. The span distance was 4 times the thickness of the molded article and the deformation rate was 1 mm/min. The strength was calculated according to the following equation.

$$ILSS = \frac{3}{4} \times (\textit{breaking load}) / [(\textit{specimen thickness}) \times (\textit{specimen width})]$$

EXAMPLE 1

Into a polymerization vessel having a comb-type stirrer, were placed 7.20 kg (40 moles) of p-acetoxybenzoic acid, 2.49 kg (15 moles) of terephthalic acid, 0.83 kg (5 moles) of isophthalic acid, and 5.45 kg (20.2 moles) of 4,4'-diacetoxydiphenyl, and the resulting mixture was brought to elevated temperature with stirring under a nitrogen gas atmosphere and polymerized at 330° C. for 3 hours. During the period, acetic acid formed was removed and the polymerization was carried out with powerful stirring. Thereafter, the system was gradually cooled and the polymer formed was taken out at 200° C. from the system. The yield of polymer was 10.88 kg, 97.8% of theoretical yield. The polymer was pulverized in a hammer mill of Hosokawa Micron Co. to give particles of 2.5 mm or less. The polymer powder was then treated in a rotary kiln in nitrogen atmosphere at 280° C. for 5 hours. The polyester obtained showed optical anisotropy at temperatures of 350° C. and higher.

The polyester obtained above was melt-spun by using a screw-type extruder of 25 mm diameter at 365° C. The nozzle used had a hole diameter of 0.08 mm and a number of holes of 800. The transparent, pale yellow fiber thus obtained was treated in nitrogen at 320° C. for 3 hours. The resulting fiber had a cross section close to a perfect circle, a diameter of 14.7 μm, a strength of 30.4 g/d, an elongation of 2.7%, and a modulus of elasticity of 1,150 g/d (the fiber is hereinafter referred to as untreated fiber).

The untreated fiber was passed continuously through a vessel containing 1% solution of glycidyl methacrylate in toluene, and then taken up round a bobbin. It was then placed in a vacuum dryer and dried at 150° C. for 3 hours. Then the pressure was brought back to normal pressure and the fiber was further kept in the dryer at 150° C. for 3 hours. The amount of glycidyl methacrylate adhered was 0.5% relative to the fiber.

The fiber thus treated was used to prepare a composite material with epoxy resin. The fiber was passed, under tension, through a methyl cellosolve solution of an epoxy resin, Sumiepoxy ELM-434 (mfd. by Sumitomo Chemical Co., Ltd.) and taken up on a drum having a circumference of 66 cm. The above epoxy resin solution contained an amine-type curing agent added thereto. The fiber strand impregnated with resin on the drum was cut into the form of a sheet, and then treated at 130° C. for 20 minutes to be converted to B-stage (semi-cured stage). The sheet was folded along the fiber direction to have a wideth of about 6 mm. A number of thus folded sheets were piled up and pressed in a mold at 170° C. for 1 hour so as to give a thickness of the molded article of 2 mm. The molded product was post-cured at 200° C., and a specified test piece was prepared therefrom. The volume fraction of the fiber in the molded article was 48%. ILSS was found to be 5.8 kg/mm$^2$.

COMPARATIVE EXAMPLE 1

The untreated fiber in Example 1 was used to be made into a composite material with epoxy resin and evaluated in the same manner as in Example 1. The volume fraction of the fiber in the composite material was 49% and the ILSS was 3.3 kg/mm$^2$, showing clearly the effect of this invention.

EXAMPLE 2

The untreated fiber in Example 1 wa subjected to a treatment of adhesion of 1% toluene solution of diglycidyl terephthalate and of drying in the same manner as in Example 1. The amount of the solution adhered was 0.6%. An epoxy resin composite material was prepared in the same manner as in Example 1. The ILSS of the material formed was found to be 5.6 kg/mm$^2$, showing a great improvement as compared with Comparative Example. The volume fraction of the fiber in the composite material was 53%.

EXAMPLE 3

The untreated fiber in Example 1 was wound round a bobbin made of teflon and placed in a glass vessel. The interior of the vessel was then replaced thoroughly with nitrogen. Thereafter, the glass vessel and another flask containing 50% fuming sulfuric acid was connected with a glass tube. Nitrogen was blown into the fuming sulfuric acid, and sulfur trioxide carried by nitrogen stream was made to contact with the fiber. The contact time was 8 minutes and the temperature was 30° C.

The treated fiber had a strength of 29.8 g/d, an elongation of 2.4%, and a modulus of elasticity of 1,280 g/d, thus showing virtually no change in these properties by the above treatment.

The treated fiber was washed with water, then dried, and made into a composite material with epoxy resin. The fiber was passed, under tension, through a methyl cellosolve solution of an epoxy resin, Sumiepoxy ELM-434 (mfd. by Sumitomo Chemical Co., Ltd.) and taken up on a drum having a circumference of 66 cm. The epoxy resin solution used above contained an amine-type curing agent added thereto.

The fiber strand impregnated with resin on the drum was cut into the form of a sheet, and then treated at 130° C. for 20 minutes to be converted into B-stage (semi-cured stage). The sheet was folded along the fiber direction to have a width of about 6 mm. A number of thus folded sheets were piled up and pressed in a mold at 170° C. for 1 hour so as to give a thickness of the molded article of 2 mm. The molded product was post-cured at 200° C. and a specified test piece was prepared therefrom. The volume fraction of the fiber in the molded article was 43%. Determination of ILSS showed a value of 6.0 kg/mm$^2$.

COMPARATIVE EXAMPLE 2

The untreated fiber in Example 1 was used to be evaluated as a composite material in the same manner as in Example 3. The ILSS of the material was 3.3 kg/mm$^2$, showing clearly the effect of this invention.

EXAMPLE 4

The untreated fiber in Example 1 was immersed in 90% aqueous sulfuric acid solution for 10 minutes. The immersion temperature was 27° C. After washing with water followed by drying, the fiber had a strength of 28.4 g/d, an elongation of 2.3%, and a modulus of elasticity of 1,280 g/d, showing thus virtually no change in these properties by the above-treatment The procedure in Example 3 was repeated to prepare an epoxy resin composite material using the fiber obtained above. The volume fraction of the fiber in the molded article was 56%, and the ILSS of the article was 6.1 kg/mm$^2$. It showed clearly the effect of this invention as compared with Comparative Example 2.

COMPARATIVE EXAMPLE 3

The untreated fiber in Example 1 was immersed in 98% sulfuric acid at 27° C. for 1 minute. After washed with water and dried, the resulting fiber had a strength of 11.3 g/d, an elongation of 1.3% and a modulus of elasticity of 880 g/d, thus showing a marked deterioration in physical properties.

EXAMPLE 5

The untreated fiber in Example 1 was immersed in 70% sulfuric acid at 50° C. for 20 minutes. After washed with water and dried, the resulting fiber had a strength of 28.3 g/d, an elongation of 2.5%, and a modulus of elasticity of 1,190 g/d, thus showing virtually no change in these properties by the treatment. An epoxy resin composite material prepared in the same manner as in Example 3 but by using the fiber obtained above showed a volume fraction of the fiber of 53% and ILSS of 5.7 kg/mm$^2$, revealing clearly the effect of this invention.

EXAMPLE 6

The sulfur trioxide-treated fiber obtained in Example 3 was used to prepare a composite material in the same manner as in Example 3 except for using polyethylene terephthalate in place of epoxy resin. The polyethylene terephthalate used was polyester RT 580 (mfd. by Toyobo Co., Ltd.), and was impregnated to the fiber as a p-chlorophenol solution. The fiber thus impregnated was wound round a drum, and then pressed in a mold at 170° C. for 10 minutes, and then dried at 200° C. for 15 minutes to obtain a molded product. The volume fraction of the fiber in the molded product was 51% and its ILSS was 5.0 kg/mm$^2$.

COMPARATIVE EXAMPLE 4

The untreated fiber in Example 1 was used to conduct a comparative test with Example 6 in the same manner as in Example 6. The polyethylene terephthalate composite material thus prepared had a volume fraction of the fiber of 52% and showed ILSS of 2.8 kg/mm$^2$.

EXAMPLE 7

The untreated fiber in Example 1 was placed in the same glass vessel in the same manner as in Example 3. Nitrogen was blown into a flask containing chlorosulfonic acid, and the resulting nitrogen gas stream containing chlorosulfonic acid was made to contact with the fiber. The time of contact was 10 minutes and the temperature was 30° C. The treated fiber was washed with water, dried, and then made into a composite material with epoxy resin in the same manner as in Example 3. ILSS was determined in the same manner as in Example 3 and found to be 6.2 kg/mm$^2$. The volume fraction of the fiber in the composite material was 48%.

EXAMPLE 8

The untreated fiber in Example 1 was placed in the same glass vessel in the same manner as in Example 3. Nitrogen was blown into a flask containing fluorosulfonic acid, and the resulting nitrogen gas stream containing fluorosulfonic acid was made to contact with the fiber. The time of contact was 10 minutes and the temperature was 30° C. The treated fiber was washed with water, dried, and then made into a composite material with epoxy resin in the same manner as in Example 3. ILSS was determined in the same manner as in Example 3 and found to be 5.8 kg/mm$^2$. The volume fraction of the fiber in the composite material was 52%.

What is claimed is:

1. A method of treating fiber which comprises subjecting a fiber obtained by melt-spinning a polyester which exhibits anisotropy in its molten state to a treatment comprising making the fiber contact with at least one member selected from the group consisting of sulfur trioxide, chlorosulfonic acid, fluorosulfonic acid, and an aqueous sulfuric acid solution having a concentration of 30 to 95% by weight.

2. A method of treatment according to claim 1, wherein at least one member selected from the group consisting of sulfur trioxide, chlorosulfonic acid, fluorosulfonic acid, and an aqueous sulfuric acid solution having a concentration of 30 to 95% by weight is made to contact with the fiber obtained by melt-spinning a polyester which exhibits anisotropy in its molten state.

3. A method of treatment according to claim 1, wherein the fiber is further heated at a temperature not higher than 300° C. after said drying.

4. A method of treatment according to claim 1, wherein the aqueous sulfuric acid solution which contacts the fiber has a concentration of 50 to 95% by weight.

5. A method of treatment according to claim 1, wherein at least one member selected from the group consisting of sulfur trioxide, chlorosulfonic acid and fluorosulfonic acid, in the form of a gas or mist is made to contact with the fiber.

* * * * *